US006131804A

United States Patent [19]

Julian

[11] Patent Number: 6,131,804

[45] Date of Patent: Oct. 17, 2000

[54] RECLOSABLE FITMENT WITH PULL OFF LINER FILM

[75] Inventor: Randall K. Julian, Emsworth, United Kingdom

[73] Assignee: Rexam Plastics Inc., Evansville, Ind.

[21] Appl. No.: 09/256,434

[22] Filed: Feb. 23, 1999

[51] Int. Cl.[7] ..... B65D 5/72

[52] U.S. Cl. ..... 229/125.09; 220/258; 220/259; 229/125.14

[58] Field of Search ..... 220/258, 259, 220/270, 359.2; 229/125.09, 125.14, 125.15

[56] References Cited

U.S. PATENT DOCUMENTS

| | | | |
|---|---|---|---|
| 3,900,155 | 8/1975 | Rausing et al. | 229/125.09 |
| 4,101,047 | 7/1978 | Geppert et al. | 220/258 |
| 4,770,325 | 9/1988 | Gordon et al. | 229/125.09 |
| 4,990,200 | 2/1991 | Heinz | 220/359.2 |
| 5,287,983 | 2/1994 | Reil et al. | 229/125.09 |
| 5,632,440 | 5/1997 | Tragardh et al. | 229/125.14 |

FOREIGN PATENT DOCUMENTS

| | | | |
|---|---|---|---|
| 2661659 | 11/1991 | France | 220/270 |

*Primary Examiner*—Gary E. Elkins
*Attorney, Agent, or Firm*—Middleton & Reutlinger; John F. Salazar

[57] ABSTRACT

A container closure has a generally planar base (2) with an aperture (5) therein which is adapted to be mounted on a wall of a container to surround an aperture therein with the two apertures in register. A flap (3) is connected to the base for movement between a closed position in which the flap overlies the base and an open position in which the base is exposed. A plug (7) formed on the flap enters into and closes the base aperture when the flap is in the closed position and a removable film strip (4) is detachably mounted on the outer surface of the base to cover and close the base aperture. The film is so constructed that it can extend around the plug when the plug is located in the base aperture.

8 Claims, 2 Drawing Sheets

RECLOSABLE FITMENT WITH PULL OFF LINER FILM

The invention relates to container closures and in particular to re-closable closures for use on containers such as cartons.

The object of the invention is to provide a closure which can be tightly re-closed after use.

Cartons used for packaging liquids are well known, for example cartons for containing milk, fruit juice and the like. Such cartons are generally made from a one-piece blank of carton board coated on both sides with polyethylene. The carton blank is folded to close the bottom and to provide either a slant top, a flat top or an upstanding (gable) top and, after filling, the carton is hermetically sealed.

It is known to provide a pouring aperture in such a carton which is hermetically sealed by a peel-off film strip. The use of such a peel-off strip is greatly favored by consumers since it provides confirmation that the closure has not been tampered with and conveys a feeling of freshness.

The object of the present invention is to provide a closure which incorporates a removable film strip and which can be tightly re-closed after use when the film strip has been removed.

Accordingly, the present invention provides a container closure comprising: a base having an aperture therein and adapted to be mounted on a wall of a container to surround an aperture therein with the two apertures in register; a flap connected to the base for movement between a closed position in which the flap overlies the base and an open position in which the base is exposed; a plug formed on the flap which enters into and closes the base aperture when the flap is in the closed position; and a removable film strip detachably mounted on the outer surface of the base to cover and close the base aperture; wherein the film is so constructed that it can extend around the plug when the plug is located in the base aperture.

Embodiments of the invention are described below with reference to the accompanying drawings, in which.

Figure 1:
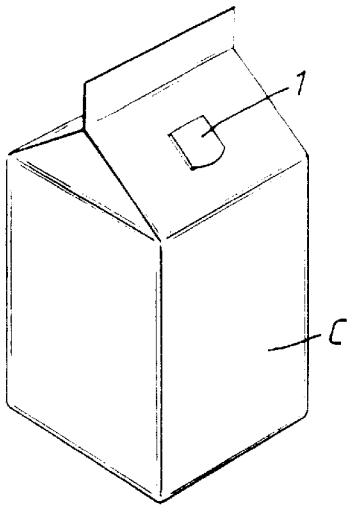
FIG. 1 is a perspective view of a carton incorporating a closure.

In FIG. 1, a closure 1 is shown mounted on a wall of a container in the form of a gable top carton C. The carton will typically be made of plastic coated carton board folded from a blank. The container wall is formed with a pouring aperture and, prior to the first opening of the closure, the container aperture is closed and sealed by the closure.

Figure 2:
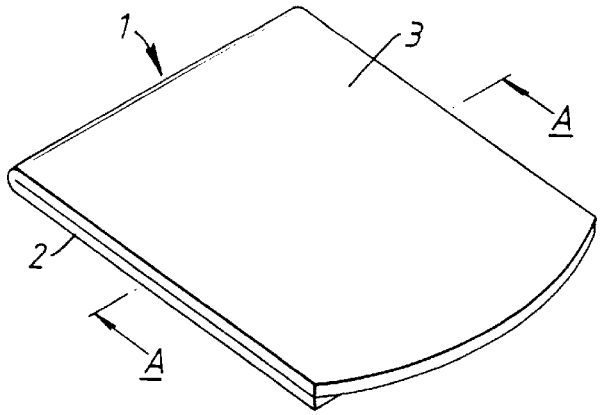
FIG. 2 is an enlarged view of the closure in the closed position.
Figure 3:
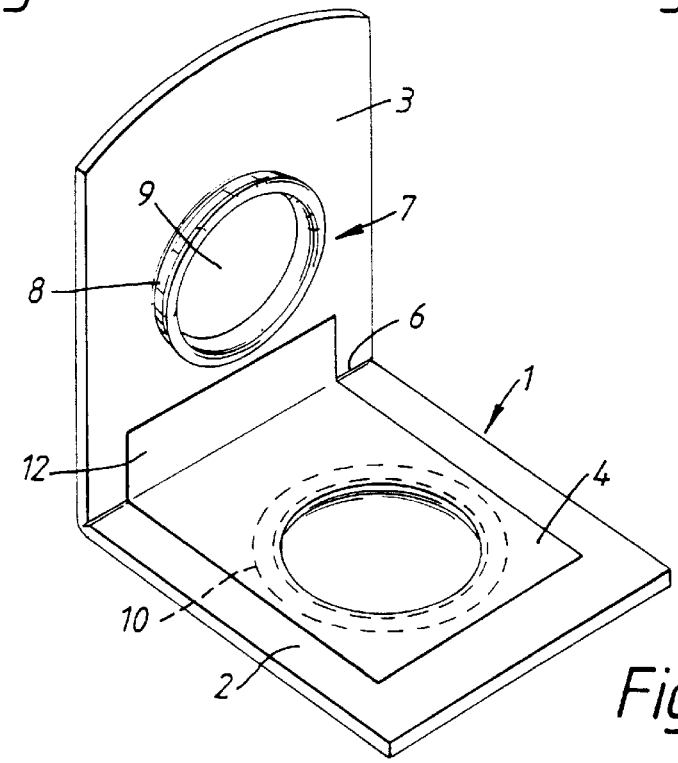
FIG. 3 is an enlarged view of the closure in an open position.
Figure 4:
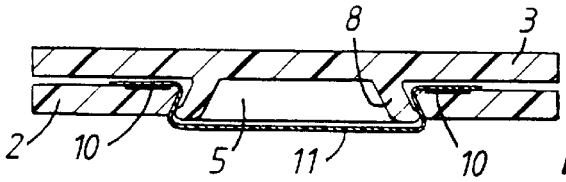
FIG. 4 is a cross-section through the closure taken along line AA in FIG. 2.

The construction of the closure is best seen in FIGS. 2–4. The closure consists of a generally planar base 2, which is adapted to be mounted on a wall of the container by an adhesive or a heat seal, a generally planar flap 3, and a removable film strip 4. The base is formed with an aperture 5 and is mounted on the container wall so as to surround the container aperture with the base aperture 5 in register with it.

The base 2 and flap 3 are formed as a single piece (such as by vacuum forming, thermo forming or injection molding) and are connected together by a hinge 6 which enables the flap 3 to move between the closed position shown in FIG. 2 and the open position shown in FIG. 3. A plug 7 is formed on the flap by a closed wall 8 raised from the flap and that part 9 of the flap which the wall surrounds. When the flap is in the closed position, the plug 7 enters into and closes the base aperture 5. In the embodiment shown, the wall 8 of the plug is inclined slightly outwardly and the base aperture 5 is undercut so that the plug is a snap-fit in the base aperture. In an alternative embodiment the plug may be a tight friction fit in the base aperture.

The removable film strip 4 is detachably mounted, by means of a heat seal 10, on the outer surface of the base to cover and close the base aperture and is so constructed that it can extend around the plug when the plug is located in the base aperture. This is best shown in FIG. 4 where it can be seen that the film strip is formed with a depression or pocket 11 which extends into the base aperture 5 and accommodates the wall 8 of the plug 7. The film strip is sufficiently thin and flexible that it does not interfere with the tight fitting of the plug 7 into the aperture 5.

The film strip has a portion 12 which is not sealed to the base 2 and which can be grasped by hand to allow the strip to be peeled from the base.

Figure 5:
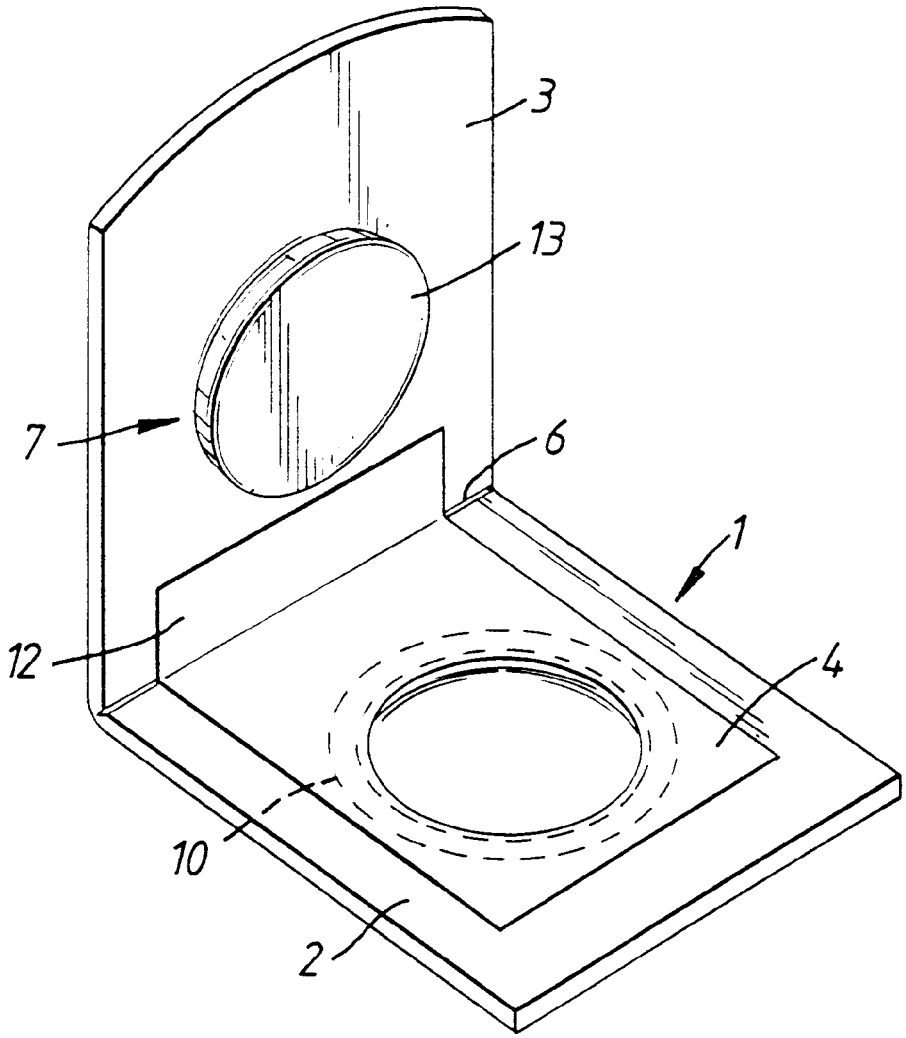
FIG. 5 is a view of another embodiment of closure the closure in an open position.
Figure 6:
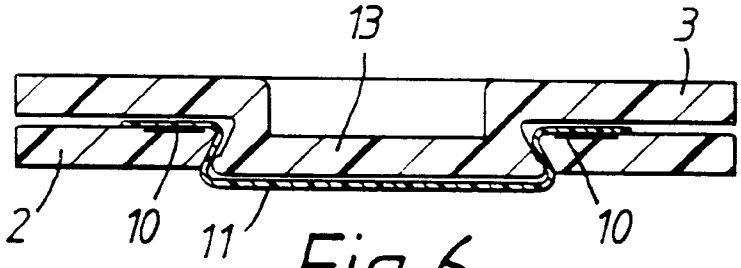
FIG. 6 is a cross-section through the closure of FIG. 5 when in the closed position.

Another embodiment is shown in FIGS. 5 and 6 where the plug is formed in the flap as a recessed pocket 13.

When the container is first opened the film strip 4 is peeled away from the base 2 and discarded. The container can be tightly re-closed by fitting the plug 7 back into the base aperture 5.

What is claimed is:

1. A container closure comprising:

a base having an aperture therein and adapted to be mounted on a wall of a container to surround an aperture therein with the two apertures in register;

a flap connected to the base for movement between a closed position in which the flap overlies the base and an open position in which the base is exposed;

a plug formed on the flap which enters into and closes the base aperture when the flap is in the closed position; and a removable film strip detachably mounted on the outer surface of the base to cover and close the base aperture;

wherein the film is so constructed that it can extend around the plug when the plug is located in the base aperture.

2. A container closure as claimed in claim 1, wherein the film strip is formed with a pocket which extends into the base aperture to receive the plug.

3. A container closure as claimed in claim 1 or claim 2, wherein the plug is a snap-fit in the base aperture.

4. A container closure as claimed in claim 1 or claim 2, wherein the plug is a tight friction fit in the base aperture.

5. A container closure as claimed in claim 1, wherein the film strip is connected to the base by a heat seal surrounding the base aperture and has a portion which is not sealed to the base and which can be grasped to peel the fill a strip from the base.

6. A container closure as claimed in claim 1, wherein the flap is generally planar and the plug is formed by a closed wall raised from the flap and that part of the flap which the wall surrounds.

7. A container closure as claimed in claim 1, wherein the plug is provided by a recessed pocket formed in the flap.

8. A container closure as claimed in claim 1, wherein the base and flap are formed as a single piece and are connected by hinge.

* * * * *

UNITED STATES PATENT AND TRADEMARK OFFICE

CERTIFICATE OF CORRECTION

PATENT NO. : 6,131,804
DATED : October 17, 2000
INVENTOR(S) : Randall K. Julian

It is certified that error appears in the above-identified patent and that said Letters Patent is hereby corrected as shown below:

Col. 2, Line 54, Claim 5, Change "fill a " to --film--.

Signed and Sealed this

Eighth Day of May, 2001

*Attest:*

Nicholas P. Godici

NICHOLAS P. GODICI

*Attesting Officer*

*Acting Director of the United States Patent and Trademark Office*